US009321571B2

(12) United States Patent
Griggio

(10) Patent No.: US 9,321,571 B2
(45) Date of Patent: Apr. 26, 2016

(54) HIGHLY FLEXIBLE CABLE CLAMP

(71) Applicant: Federico Griggio, Saonara (IT)

(72) Inventor: Federico Griggio, Saonara (IT)

(73) Assignee: SAPISELCO SRL, Saonara (PD) (IT)

( * ) Notice: Subject to any disclaimer, the term of this patent is extended or adjusted under 35 U.S.C. 154(b) by 0 days.

(21) Appl. No.: 14/283,537

(22) Filed: May 21, 2014

(65) Prior Publication Data

US 2014/0373312 A1 Dec. 25, 2014

(30) Foreign Application Priority Data

Jun. 19, 2013 (IT) ..... PD2013A0171

(51) Int. Cl.
*B65D 63/10* (2006.01)

(52) U.S. Cl.
CPC ..... *B65D 63/1072* (2013.01); *B65D 63/1063* (2013.01); *Y10T 24/1498* (2015.01)

(58) Field of Classification Search
CPC ..... B65D 63/1027; B65D 63/1063; B65D 63/1072; Y10T 24/1498
USPC ..... 24/16 PB
See application file for complete search history.

(56) References Cited

U.S. PATENT DOCUMENTS

| | | | | |
|---|---|---|---|---|
| 5,267,373 | A | 12/1993 | Chisek | |
| 6,185,792 | B1 * | 2/2001 | Nelson et al. | 24/16 PB |
| 2002/0104196 | A1 | 8/2002 | Geiger | |
| 2006/0242800 | A1 * | 11/2006 | Pettersson | 24/16 PB |

FOREIGN PATENT DOCUMENTS

| | | |
|---|---|---|
| GB | 2067240 | 7/1981 |
| JP | S477286 | 9/1972 |
| JP | S5291383 | 7/1977 |
| JP | S52120980 | 9/1977 |
| JP | S6062064 | 4/1985 |
| JP | S60172669 | 9/1985 |
| JP | H11292130 | 10/1999 |
| JP | 2000226062 | 8/2000 |
| WO | 2010087038 | 8/2010 |

* cited by examiner

*Primary Examiner* — Robert J Sandy
*Assistant Examiner* — David Upchurch
(74) *Attorney, Agent, or Firm* — Themis Law

(57) ABSTRACT

A highly flexible cable tie includes comprising a head portion and a tail portion, the tail portion having one end joined to the head portion, the head portion being provided with an opening for the passage of the tail portion and with an elastic locking tooth, the tail portion being linear in shape, with a generically rectangular cross section, and having on a wider side saw -tooth projections configured to engage the flexible locking tooth of the head portion and to prevent the tail portion from sliding out of the opening of the head portion, the clamp having at least one projection on the wall to which the flexible locking tooth is joined, the projection being configured to limit the bending of the flexible locking tooth toward the wall to which the elastic tooth is joined. The tail portion has no ribs, projections, or raised lateral edges beside the saw-tooth projections.

3 Claims, 2 Drawing Sheets

HIGHLY FLEXIBLE CABLE CLAMP

FIELD OF THE INVENTION

The present invention relates to the field of fastening devices, and in particular relates to a tie with a self-locking design.

BACKGROUND OF THE INVENTION

Self-locking cable clamps or ties comprising a head having a ratchet contained in a slotted case on one end and a tail at the other end suited to be inserted into the head to form a loop are already known.

These self-locking ties are mainly used to fasten cables or pipes.

The head of a self-locking cable tie has a substantially prismatic shape, preferably cylindrical or parallelepiped, an axial opening large enough to allow the tail of the tie to be inserted, and a pawl or a flexible tooth inside said axial opening.

The tail of known self-locking ties is substantially composed of a linear U-shaped section having one end connected to the head and a saw-tooth gear rack within the U-shaped section.

The tail of known self-locking ties is composed of a substantially flat strap having two raised edges and a saw-tooth gear rack between the previously mentioned raised edges.

The coupling of the head and tail occurs when the tail is inserted into the head and the flexible pawl on the head engages the backside of the saw teeth on the tail.

The direction of insertion of the tail in the opening of the head requires that the side with the sawtooth gear rack face the inside of the loop formed by the tail inserted into the head of the tie.

The materials commonly used to make self-locking cable ties are polyamide, plastic materials, or in any case materials with a certain flexibility.

Even the use of relatively flexible materials limits the bending of the tail of the ties in question, which cannot be used on items with very small diameters, such as the necks of bags or thin cables.

Patent EP2195251 describes a highly flexible tie since it has no raised edges or side ribs.

The absence of ribs, or side edges, facilitates the bending of the tail but it has been found that the tail itself, as a consequence of having no guides, can move and be unstable when inserted in the head.

The tie with no ribs or raised edges, which serve as guides, can therefore move or be opened.

Essentially, high flexibility ties have a tail made up of a base strap having a saw-tooth gear rack projecting from one side of the strap itself These high flexibility straps allow even narrow items to be tightened and fastened but have the disadvantage that the tail inserted in the opening of the head is not stable, may rotate or move laterally, and the locking pawl or tooth does not exert adequate pressure on the saw-tooth gear rack.

These possible movements and insufficient pressure exerted by the locking tooth do not adequately prevent the tail from slipping back through the opening of the head.

SUMMARY OF THE INVENTION

To overcome all the aforementioned drawbacks, a new type of highly flexible self-locking tie has been developed and produced.

One purpose of the new highly flexible self-locking tie is to prevent the tail from slipping back through the opening of the head.

Another purpose of the new highly flexible self-locking tie is to have better bending resistance of the locking pawl or tooth so to prevent the loop from opening.

These and other purposes, direct and complementary, are achieved by a new highly flexible self-locking tie according to the invention.

The new self-locking tie comprises, in its main parts, a head, equipped with a slotted opening and a flexible locking tooth or pawl, and a tail portion, with a saw-tooth gear rack, configured to be inserted into the opening of the head portion to form a loop.

The head of the new self-locking tie has an opening and a flexible locking tooth.

This head portion has a generally prismatic shape, preferably cylindrical or parallelepiped, having a generally rectangular opening or slot large enough to allow the tail portion to slide through.

Inside the aforementioned opening there is a flexible locking tooth.

In particular, the flexible locking tooth is comprised of an appendage, joined in a flexible manner to an inner wall larger than the opening, and having one or more projecting elements on its surface facing the wall opposite the one it is joined to.

The flexible locking tooth is joined internally to the opening of the head so to rotate and flex on a plane parallel to the axis of the opening.

Internally to the opening, on the wall to which the flexible locking tooth is joined, there is a projection facing the wall opposite the opening and parallel to the axis of the opening.

This projection is suited to limit the bending of the flexible locking tooth toward the wall to which the flexible tooth is joined.

The tail of the new self-locking tie comprises a linear element with a substantially rectangular section suited to be inserted into the opening of the head, having one end connected to the head itself and the opposite end radiused and rounded to facilitate its insertion into the opening of head.

On one of the two widest sides of the tail there is a series of saw-tooth shaped projections suitably oriented with respect to the flexible locking tooth of the head to allow the insertion of the tail in the opening of the head but also having a profile designed to prevent the extraction of the tail from the opening of the head.

The coupling between the head and the free end of the tail takes place by engaging the flexible tooth of the head on the saw-tooth gear rack constituted by the aforementioned shaped projections of the tail.

In particular, the tail of the tie has none of the raised edges or side ribs that are present in the self-locking cable ties in the prior art.

BRIEF DESCRIPTION OF THE DRAWINGS

The features of a highly flexible self-locking cable tie according to the invention will be better clarified by the following description with reference to the drawings illustrating a non-limiting example.

DETAILED DESCRIPTION OF EMBODIMENTS OF THE INVENTION

Figure 1A:
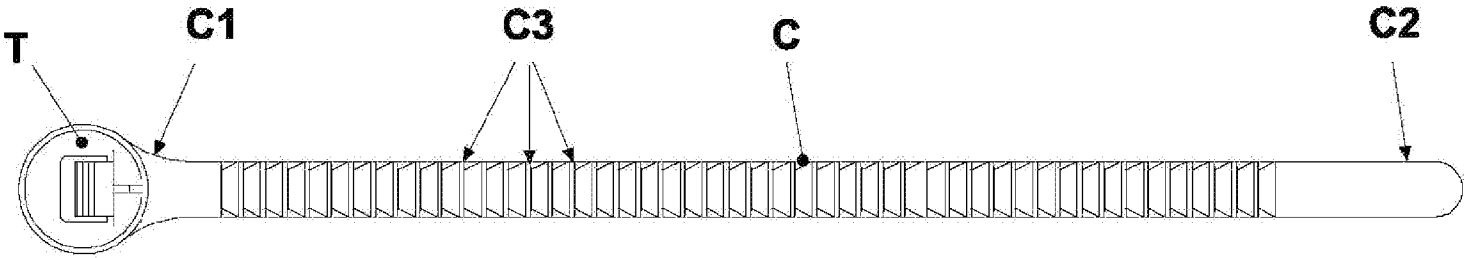
FIGS. 1*a* and 1*b* respectively illustrate a front view and a side view of an embodiment of a tie according to the invention, and FIGS. 2*a* and 2*b* respectively illustrate a front view and a section of the head (T) of the tie of FIGS. 1*a* and 1*b*.
Figure 1B:
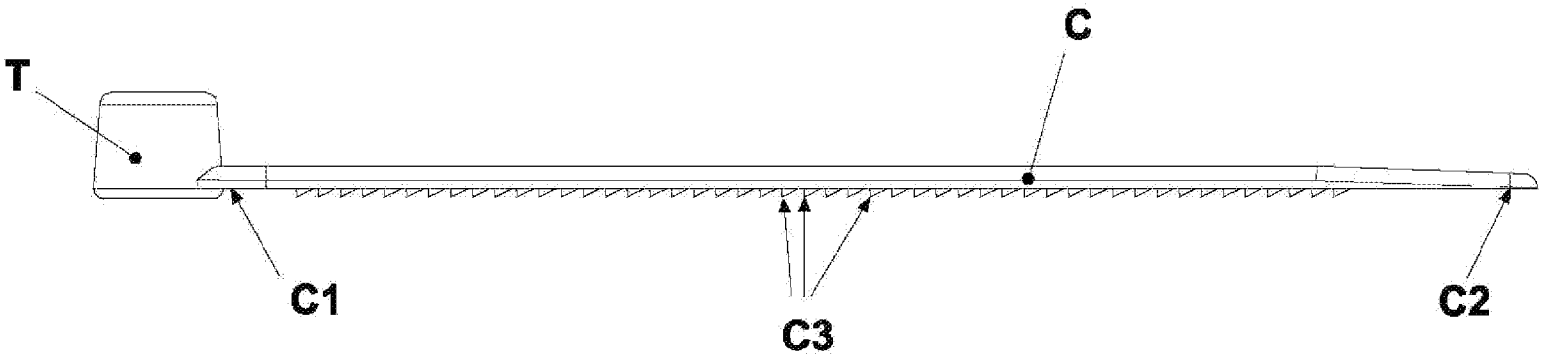
Figure 2A:
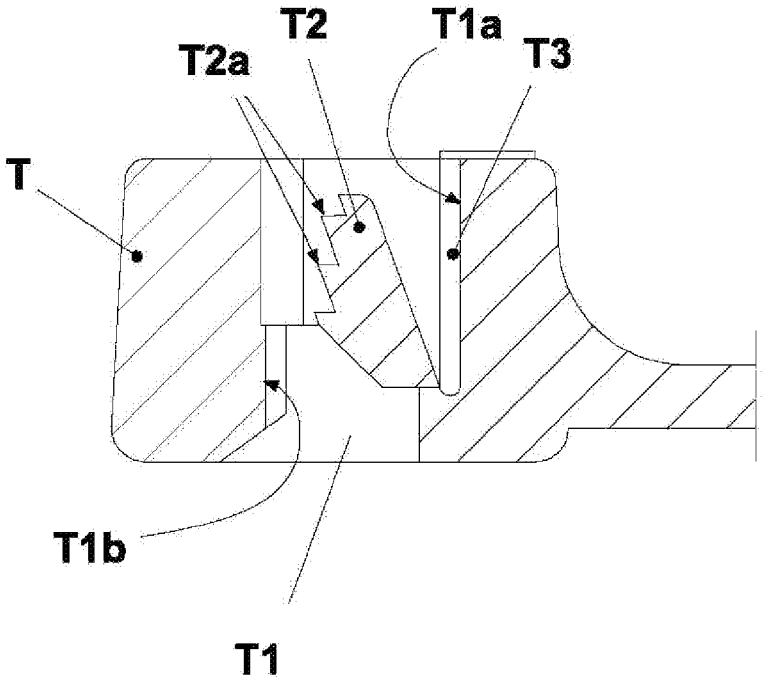
Figure 2B:
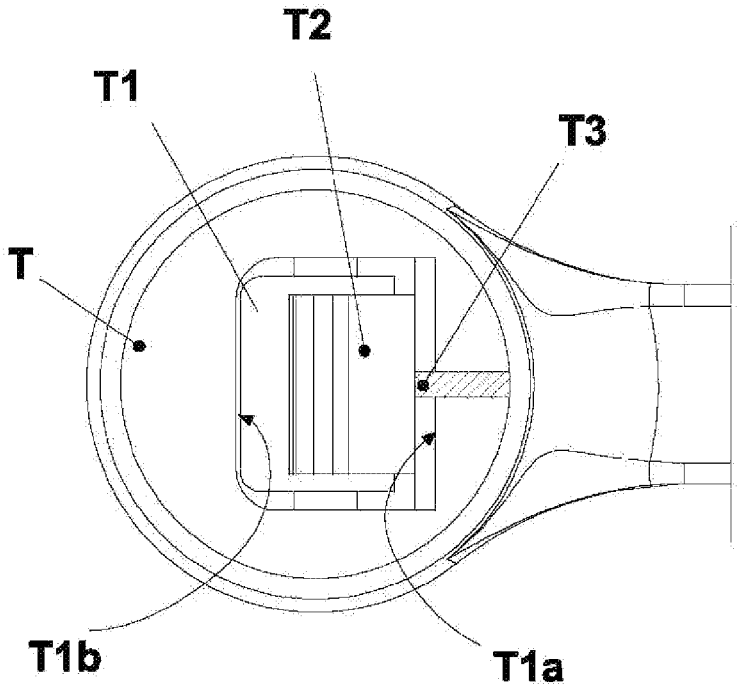

A tie according to the invention comprises a head (T), cylindrical or frustoconical, and a tail (C) featuring a linear shape, with a substantially rectangular section, having one end joined to the head (T).

In one embodiment, the head (T) of the self-locking tie has an opening (T1) and a flexible locking tooth (T2).

The opening (T1) of the head (T) is generally rectangular and large enough to enable the tail (C) of the tie to slide in.

Within the opening (T1) there is the flexible locking tooth (T2), consisting of an appendage, joined in a flexible manner to an inner wall (T1*a*) of the opening (T1), and having one or more projections (T2*a*) on its surface facing the opposite wall (T1*b*) with respect to the wall (T1*a*) to which it is joined.

Internally to the opening (T1), on the wall (T1*a*) to which the flexible locking tooth (T2) is joined, there is a projection (T3) facing the opposite wall (T1*b*) of the opening and parallel or substantially parallel to the longitudinal axis of the opening (T1).

The tail (C) of the self-locking tie comprises a linear element with a rectangular or substantially rectangular section suited to be inserted into the opening (T1) of the head (T), having one end (C1) connected to the head (T) and the opposite end (C2) rounded and radiused to facilitate its insertion into the opening (T1) of the head (T).

On one of the two widest sides of the tail (C) there is a series of saw-tooth projections (C3) oriented with respect to the flexible locking tooth (T2) of the head (T) so as to allow the insertion of the tail (C) in the opening (T1) of the head (T) but simultaneously preventing the tail (C) from slipping back through the opening (T1) of the head (T).

Unlike the tails (C) in the prior art, the tail (C) has no projections, ribs or raised elements along the edges of the saw-tooth projections (C3).

While the invention has been described in connection with the above described embodiments, it is not intended to limit the scope of the invention to the particular forms set forth, but on the contrary, it is intended to cover such alternatives, modifications, and equivalents as may be included within the scope of the invention. Further, the scope of the present invention fully encompasses other embodiments that may become obvious to those skilled in the art and the scope of the present invention is limited only by the appended claims.

Therefore, with reference to the above description and the annexed drawings, the following claims are made.

The invention claimed is:

1. A highly flexible cable tie comprising:

a head portion (T);

a tail portion (C), wherein said tail portion (C) has one end (C1) joined to said head portion (T), said head portion (T) being provided with an opening (T1) configured for passage of said tail portion (C) and with a flexible locking tooth (T2) provided inside said opening, said tail portion (C) being linear in shape, with a generically rectangular cross section, and having, extending upwardly from a wider side, saw-tooth projections (C3) configured to engage said flexible locking tooth (T2) of said head portion (T) and to prevent said tail portion (C) from sliding out of the opening (T1) of said head portion (T); and at least one projection (T3) on a wall (T*a*) to which said flexible locking tooth (T2) is joined, said projection (T3) being configured as a columnar rib having a longer side and a narrower side perpendicular to the longer side, the longer side extending longitudinally toward an end of the opening to limit a bending of said flexible locking tooth (T2) toward the wall (T1*a*) to which said flexible locking tooth (T2) is joined.

2. The highly flexible cable tie according to claim 1, wherein said tail portion (C) has no ribs, projections, or raised lateral edges beside the saw-tooth projections (C3).

3. The highly flexible cable tie according to claim 1, wherein the longer side of said projection (T3) disposed inside said opening (T1) of said head portion (T) is linear and extends to the end of the opening (T1).

* * * * *